US008558648B2

(12) United States Patent
Choi

(10) Patent No.: US 8,558,648 B2
(45) Date of Patent: Oct. 15, 2013

(54) ELECTROMAGNETIC SWITCHING APPARATUS

(75) Inventor: Yeon Soon Choi, Gyeongsangbuk-Do (KR)

(73) Assignee: LSIS Co., Ltd., Anyang, Gyeonggi-Do (KR)

( * ) Notice: Subject to any disclaimer, the term of this patent is extended or adjusted under 35 U.S.C. 154(b) by 0 days.

(21) Appl. No.: 13/274,254

(22) Filed: Oct. 14, 2011

(65) Prior Publication Data

US 2012/0092100 A1 Apr. 19, 2012

(30) Foreign Application Priority Data

Oct. 15, 2010 (KR) ..... 10-2010-0100884

(51) Int. Cl.
*H01H 1/00* (2006.01)
*H01H 51/22* (2006.01)
*H01H 67/02* (2006.01)

(52) U.S. Cl.
USPC ..... 335/83; 335/126; 200/245

(58) Field of Classification Search
USPC ..... 335/126, 131, 133; 200/243, 248, 250
See application file for complete search history.

(56) References Cited

U.S. PATENT DOCUMENTS

| | | | | |
|---|---|---|---|---|
| 1,807,815 | A * | 6/1931 | White | 335/193 |
| 2,828,381 | A * | 3/1958 | Davies et al. | 335/160 |
| 3,177,305 | A * | 4/1965 | Lehman | 200/6 B |
| 3,205,333 | A * | 9/1965 | Bonnefois et al. | 200/325 |
| 3,272,949 | A * | 9/1966 | Leland | 200/243 |
| 3,293,397 | A * | 12/1966 | Zubaty et al. | 200/401 |
| 4,554,427 | A * | 11/1985 | Flick et al. | 200/250 |
| 4,901,045 | A * | 2/1990 | Eley | 335/70 |
| 6,337,612 | B1 * | 1/2002 | Kim et al. | 335/4 |
| 6,392,173 | B1 * | 5/2002 | Hirano et al. | 200/245 |
| 6,911,884 | B2 * | 6/2005 | Uotome et al. | 335/132 |
| 7,138,894 | B2 * | 11/2006 | Lo | 335/132 |
| 7,859,373 | B2 * | 12/2010 | Yamamoto et al. | 335/126 |
| 7,876,183 | B2 * | 1/2011 | Uruma et al. | 335/126 |
| 2009/0243771 | A1 * | 10/2009 | Uruma et al. | 335/193 |

FOREIGN PATENT DOCUMENTS

| | | |
|---|---|---|
| EP | 0798752 | 10/1997 |
| EP | 1953784 | 8/2008 |
| EP | 2385538 | 11/2011 |
| JP | 57-36649 | 2/1982 |
| JP | 57-55148 | 3/1982 |
| JP | 04-267027 | 9/1992 |

OTHER PUBLICATIONS

European Patent Office Application Serial No. 11185198.6, Office Action dated Apr. 8, 2013, 4 pages.
Japan Patent Office Application Serial No. 2011-226796, Office Action dated Feb. 26, 2013, 3 pages.

* cited by examiner

*Primary Examiner* — Alexander Talpalatski
(74) *Attorney, Agent, or Firm* — Lee, Hong, Degerman, Kang & Waimey

(57) ABSTRACT

Disclosed is an electromagnetic switching apparatus capable of reducing noise occurring when a movable contact comes in contact with or is separated from a fixed contact, and capable of enhancing a function to extinguish arcs. The electromagnetic switching apparatus includes a fixed terminal fixed in a manner to penetrate through a housing, a fixed contact configured to approach to or to be separated from the fixed terminal, an elastic member fixed between the fixed terminal and the fixed contact, and providing an elastic force to a direction to separate the fixed contact from the fixed terminal, a movable contact configured to contact or to be separated from the fixed terminal, and a moving unit configured to move the movable contact so as to contact or to be separated from the fixed contact.

4 Claims, 3 Drawing Sheets

ELECTROMAGNETIC SWITCHING APPARATUS

CROSS-REFERENCE TO RELATED APPLICATION

Pursuant to 35 U.S.C. 119(a), this application claims the benefit of earlier filing date and right of priority to Korean Patent Application No. 10-2010-0100884, filed on Oct. 15, 2010, the contents of which is hereby incorporated by reference herein in its entirety.

BACKGROUND OF THE INVENTION

1. Field of the Invention

The present invention relates to an electromagnetic switching apparatus, and particularly, to an electromagnetic switching apparatus applied to an electric vehicle and so on.

2. Background of the Invention

An electromagnetic switching apparatus is a motor type switch which performs an electric relaying function. This electromagnetic switching apparatus generally indicates a connection conversion apparatus for connecting or disconnecting a main circuit by a change of a low input current. This electromagnetic switching apparatus includes a contact type switching apparatus, a non-contact type switching apparatus, a pressure switching apparatus, an optical switching apparatus, etc. Among these types, the contact type switching apparatus is being widely used in an indicator light for a vehicle, or a wiper motor, etc. due to its simplified structure.

In an electric vehicle such as a hybrid vehicle, a fuel cell vehicle, a golf cart and a motor forklift, the electromagnetic switching apparatus is installed between an accumulator and a direct current (DC) converter to supply DC power from the accumulator to the DC converter, or to interrupt DC power supply to the DC converter from the accumulator.

In an eco-friendly generation system such as a solar power generation system and a wind power generation system, the electromagnetic switching apparatus is installed between a DC generator and an inverter for converting DC power into alternating current (AC) power having a commercial frequency and a voltage, and thus to supply power from the DC generator to the inverter, or to interrupt current supply to the inverter from the DC generator.

In the electromagnetic switching apparatus used in an electric vehicle, the occurrence of arcs has to be minimized, and the occurrence of noise has to be minimized for a quiet indoor atmosphere.

SUMMARY OF THE INVENTION

Therefore, an aspect of the detailed description is to provide an electromagnetic switching apparatus capable of reducing noise occurring when a movable contact comes in contact with or is separated from a fixed contact, and capable of enhancing a function to extinguish arcs.

To achieve these and other advantages and in accordance with the purpose of this specification, as embodied and broadly described herein, there is provided an electromagnetic switching apparatus, comprising: an extinguishing unit configured to switch an external device; and a driving unit having an actuator, and configured to control open and close of a contact by using an electric signal, wherein the extinguishing unit comprises a fixed terminal fixed in a manner to penetrate through a housing; a fixed contact configured to approach to or to be separated from the fixed terminal; and an elastic member fixed between the fixed terminal and the fixed contact, and providing an elastic force to a direction to separate the fixed contact from the fixed terminal.

According to another aspect of the present invention, there is provided an electromagnetic switching apparatus, comprising: a fixed terminal fixed in a manner to penetrate through a housing; a fixed contact configured to approach to or to be separated from the fixed terminal; an elastic member fixed between the fixed terminal and the fixed contact, and providing an elastic force to a direction to separate the fixed contact from the fixed terminal; a movable contact configured to contact or to be separated from the fixed terminal; and a moving unit configured to move the movable contact so as to contact or to be separated from the fixed contact.

The elastic member of the electromagnetic switching apparatus may be implemented as a compression coil spring having one end fixed to the fixed terminal, and another end fixed to the fixed contact. At the fixed terminal, may be formed a stopper inserted into a central part of the compression coil spring, and configured to maintain a constant gap between the fixed terminal and the fixed contact when the fixed terminal approaches to the fixed contact.

By the elastic member of the electromagnetic switching apparatus of the present invention, may be reduced noise occurring when the movable contact comes in contact with or is separated from the fixed contact.

In the present invention, noise occurring when the electromagnetic switching apparatus is driven may be reduced, and an arc may be extinguished. This may improve a switching function, and enhance the stability of the apparatus.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
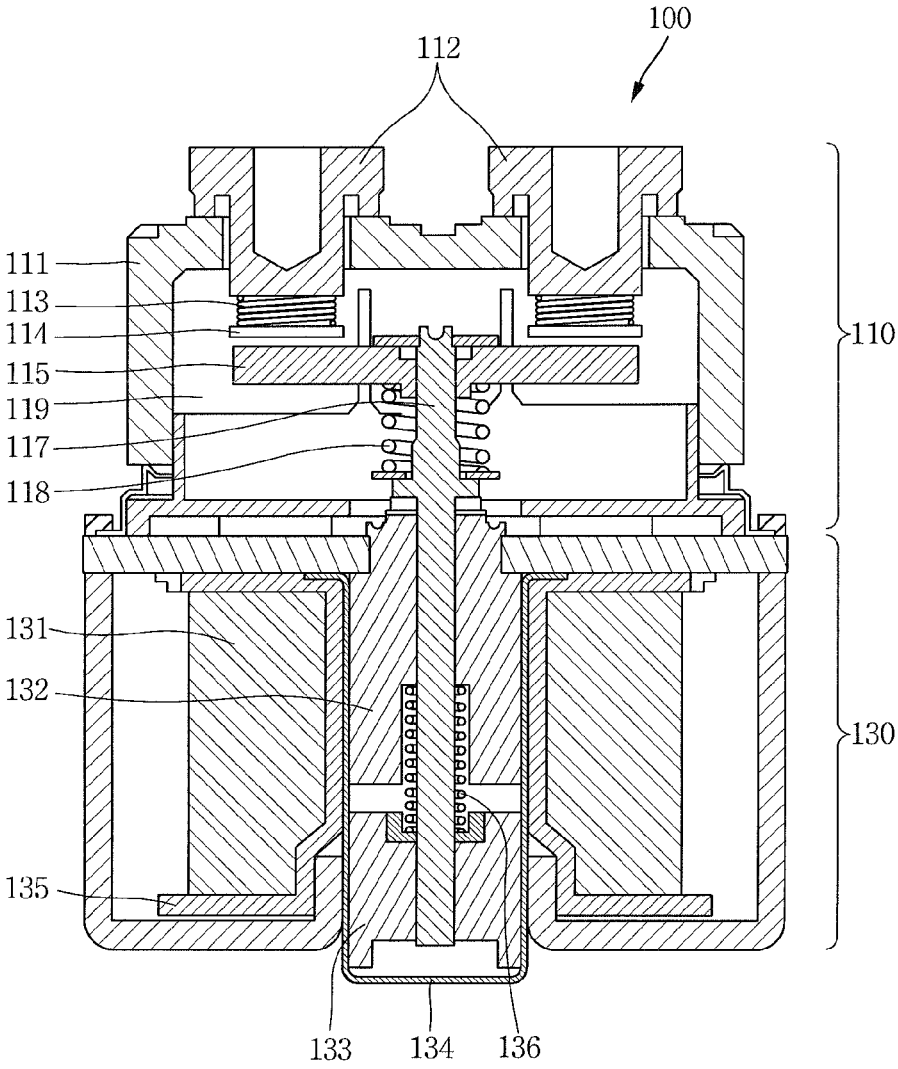
FIG. 1 is a configuration view of an electromagnetic switching apparatus according to a first embodiment of the present invention.

FIG. 1 is a configuration view of an electromagnetic switching apparatus according to a first embodiment of the present invention. Referring to FIG. 1, the electromagnetic switching apparatus 100 comprises an extinguishing unit 110 and a driving unit 130.

The extinguishing unit 110 consists of a housing 111, a fixed terminal 112, a movable terminal 115 and a shaft 117. The extinguishing unit 110 is configured to open and close a contact between the fixed terminal 112 and the movable terminal 115, such that an external device connected to the electromagnetic switching apparatus 100 is switched on/off.

The housing 111 is formed in a box shape, and is formed of a heat-resistant material such as ceramic. The housing 111 is bonded onto the driving unit 130, and accommodates therein components of the extinguishing unit 110 to protect them from the outside. An opening is formed at a lower part of the housing 111 so as to be bonded with an upper plate of the driving unit 130. Two terminal holes may be formed at an upper part of the housing 111, through which the fixed terminal 112 is coupled to the movable terminal 115.

The housing 111 formed in a box shape and having an opening at a lower part thereof is installed on the driving unit 130. Through the terminal holes of the housing 111, the fixed contact and the fixed terminal 112 are inserted into the housing 111. In the housing 111, a movable contact is arranged to be spacing from the fixed contact disposed at a lower end of the fixed terminal 112. The movable contact is coupled to the shaft 117, and is configured to contact or to be separated from the fixed contact for switching.

The housing 111 may be bonded to an upper plate of the driving nit 130 by using a connector, thereby forming an arc extinguishing space 119 to accommodate therein the fixed terminal 112 and the movable terminal 115. A lower part of the housing 111 may be connected to the driving unit 130 by using a connector formed of a metallic material, etc. The housing 111 and the driving unit 130 may be hermetically bonded to each other through a bonding process such as welding. Insulation gas having hydrogen as a main component is filled in the arc extinguishing space 119 in a sealed state. This may remove arcs occurring when the contacts of the fixed terminal 112 and the movable terminal 115 come in contact with each other, or are separated from each other.

The fixed terminal 112 is formed in a cylindrical shape, and is implemented as an electric conductor formed of copper, etc. The fixed terminal 112 is provided with a fixed contact at a lower end thereof, and is provided with a shielding portion at an upper end thereof. An external device is connected to the shielding portion. The fixed terminal 112 is penetratingly-fixed to the housing 111 through the hole formed at the upper part of the housing 111. Even if a lower end of the fixed terminal 112 can pass through the hole formed at the upper part of the housing 111, an upper end of the fixed terminal 112 cannot pass through the hole due to its bigger size than the hole. Accordingly, the upper end of the fixed terminal 112 may be positioned outside the housing 111, and the lower end of the fixed terminal 112 may be positioned at the arc extinguishing space 119 inside the housing 111.

Once the fixed contact formed at the lower end of the fixed terminal 112 comes in contact with the movable terminal 115, a current is supplied to an external device connected to the upper end of the fixed terminal 112. On the other hand, if the fixed contact is separated from the movable terminal 115, current supply to the external device connected to the upper end of the fixed terminal 112 is interrupted. Accordingly, the electromagnetic switching apparatus 100 may operate as a motor type switch which performs an electric relaying function.

The movable terminal 115 is implemented in the form of a plate, and is implemented as an electric conductor formed of copper, etc. A movable contact is formed on an upper surface of the movable terminal 115. The movable contact is integrally formed with the movable terminal 115. The movable terminal 115 may be accommodated in the arc extinguishing space 119, and may contact or be separated from the fixed contact of the fixed terminal 112 while moving in the arc extinguishing space 119. If arcs occur when the movable contact of the movable terminal 115 comes in contact with or is separated from the fixed contact of the fixed terminal 112, the occurred arcs may be extinguished.

The shaft 117 may connect the driving unit 130 and the extinguishing unit 110 to each other by penetrating through each central part of the driving unit 130 and the extinguishing unit 110 in an axial direction. For this, a through hole may be formed at a central part of the driving unit 130 so as to guide a motion of the shaft 117. The movable terminal 115 of the extinguishing unit 110 may be connected to an upper end of the shaft 117, and a movable core 133 of the driving unit 130 may be coupled to a lower end of the shaft 117. When the movable core 133 of the driving unit 130 moves in up and down directions, the shaft 117 transmits the up-down motion of the movable core 133 to the movable terminal 115. This may allow the movable terminal 115 to contact or to be separated from the fixed terminal 112.

In the electromagnetic switching apparatus 100 according to the first embodiment of the present invention, the movable terminal 115 of the extinguishing unit 110 may be provided with a contact pressure spring 118 at a lower part thereof. The shaft 117 connected to the lower part of the movable terminal 115 may be positioned at an intermediate space of the contact pressure spring 118. That is, the contact pressure spring 118 may be positioned at the circumference of the shaft 117. The contact pressure spring 118 may have an elastic force in a direction toward the fixed terminal 112 when the movable terminal 115 comes in contact with the fixed terminal 112. By the contact pressure spring 118, the fixed terminal 112 and the movable terminal 115 may maintain a contacted state therebetween with a pressure more than a predetermined value.

Furthermore, the contact pressure spring 118 may reduce a moving speed of the shaft 117 when the movable terminal 115 is separated from the fixed terminal 112, thereby attenuating an impact force occurring when the movable cores 133 and 123 of the driving unit 130 come in contact with a plunger cap 134. This may restrict the occurrence of noise and vibrations.

Hereinafter, the driving unit 130 will be explained in more details.

The driving unit 130 includes an actuator configured to control switching on/off by using an electric signal. Generally, the electromagnetic switching apparatus 100 is configured to switch on/off an external device connected thereto by up-down moving the driving unit 130 through the actuator. The driving unit 130 may consist of an exciting coil 131 configured to generate a driving force of the movable contact by generating a magnetic force due to an electric signal, a fixed core 132 fixed in the exciting coil 131, and a movable core 133 disposed to face the fixed core 132.

A coil bobbin 135 on which the exciting coil 131 is wound is provided between the exciting coil 131 and the fixed and movable cores 132, 133. The fixed core 132 and the movable core 133 are arranged in upper and dower directions along an axial direction of the coil bobbin 135. The fixed core 132 and the movable core 133 form a magnetic path through which a magnetic flux density generated by the exciting coil 131 passes. By the magnetic flux density generated by the exciting coil 131, the movable core 133 has a driving force to move in upper and lower directions.

Between the coil bobbin 135 and the fixed and movable cores 132,133, disposed is a plunger cap 134 formed of a non-magnetic material and formed in a cylindrical shape having an open surface at the extinguishing unit side and having a closed bottom surface at the opposite side. The plunger cap 134 is formed in a shape of a vessel to accommodate the fixed core 132 and the movable core 133 therein. Each of the fixed core 132 and the movable core 133 is formed to have an outer diameter approximately equal to an inner diameter of the plunger cap 134. The movable core 133 is moveable to an axial direction of the plunger cap 134.

A moving range of the movable core 133 is determined between a contact position to the fixed core 132, and an initial position separated from the bottom surface of the plunger cap 134. A contact force to contact the movable core 133 to the fixed core 132 is provided by a coil spring by the exciting coil 131, and a spring force in a direction that the movable core 133 returns to the initial position is provided by a return spring 136. A through hole for fitting the fixed core 132 thereinto is installed at a central part of the driving unit 130, and the fixed core 132 is fixed to the driving unit 130 in a fitted manner to the through hole. The movable core 133 approaching to or spacing from the fixed core 132 is provided at a central part of the driving unit 130. A guide configured to guide a motion of the movable core 133 may be provided at an inner side of the coil bobbin 135 of the driving unit 130.

Once a current is applied to the exciting coil 131, a magnetic flux is generated at the periphery of the exciting coil 131. By this magnetic flux, the fixed core 132 and the movable core 133 have different polarities. As the movable core 133 is attracted to the fixed core 132, the movable core 133 and the fixed core 132 come in contact with each other. When the movable core 133 is disposed at a contact position to the fixed core 132, the fixed terminal 112 and the movable terminal 115 come in contact with each other. Once the fixed terminal 112 and the movable terminal 115 come in contact with each other, power is supplied to an external device.

When current supply to the exciting coil 131 is interrupted, a magnetic force is not generated from the exciting coil 131 any longer, and the movable core 133 loses its driving force. As a result, the movable core 133 returns to the initial position by an elastic force of the return spring 136. At the same time, the shaft 117 moves, and the movable terminal 115 is separated from the fixed terminal 112. Here, the return spring 136 is accommodated in a spring accommodation recess of the fixed core 132. When the movable core 133 moves to a contact position to the fixed core 132, the return spring 136 does not interfere with the contact between the movable core 133 and the fixed core 132. The reason is because the entire part of the return spring 136 has been accommodated in the spring accommodation recess in a compressed state. Once the movable core 133 returns to the initial position, power supply to the external device is stopped.

Figure 2:
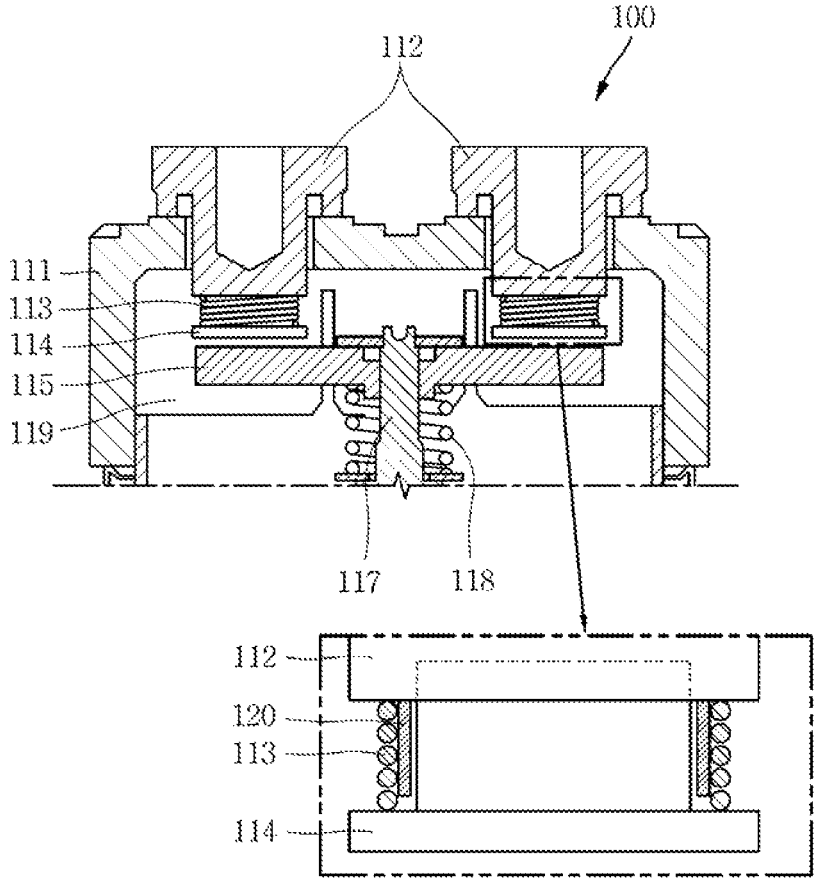
FIG. 2 is a configuration view of an extinguishing unit of the electromagnetic switching apparatus according to a first embodiment of the present invention.

FIG. 2 is a configuration view of the extinguishing unit of the electromagnetic switching apparatus according to the first embodiment of the present invention. Referring to FIG. 2, the fixed terminal 112 is fixed in a manner to penetrate through the housing 111. An upper end of the fixed terminal 112 is positioned outside the housing 111, and a lower end of the fixed terminal 112 is positioned inside the housing 111. A fixed contact 114 may be formed so as to contact or to be spacing from the lower end of the fixed terminal 112. The fixed contact 114 comes in contact with a movable contact of the movable terminal 115. Between the fixed terminal 112 and the fixed contact 114, may be fixed an elastic member configured to provide an elastic force in a direction to separate the fixed contact 114 from the fixed terminal 112.

The elastic member may be implemented as a compression coil spring 113 having one end fixed to the fixed terminal 112, and another end fixed to the fixed contact 114. When force is applied toward the fixed terminal 112, the compression coil spring 113 provides an elastic force to the opposite direction. The more force is applied to the fixed terminal 112, the more an elastic force is applied to the opposite direction. This configuration may reduce noise occurring when the fixed contact 114 and the movable terminal 115 come in contact with each other. Furthermore, when the fixed contact 114 and the movable terminal 115 come in contact with each other, the occurrence of arcs may be reduced as the compression coil spring 113 absorbs an impact force.

Figure 3:
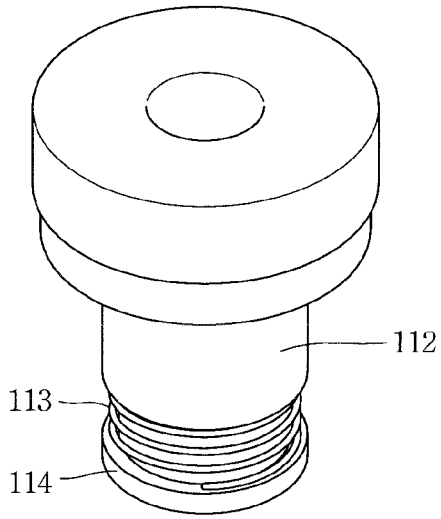
FIG. 3 is a perspective view showing a state before a fixed terminal has been compressed according to a first embodiment of the present invention.
Figure 4:
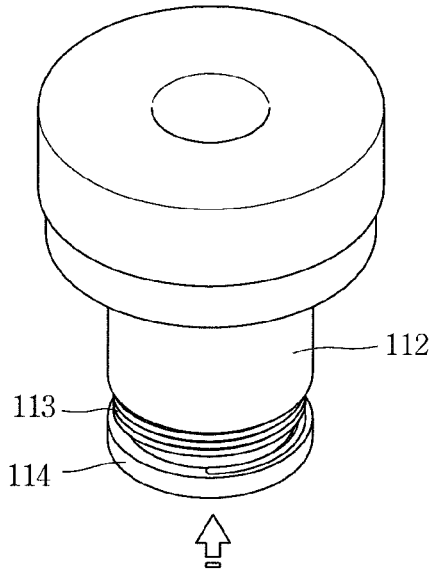
FIG. 4 is a perspective view showing a state after a fixed terminal has been compressed according to a first embodiment of the present invention.

FIG. 3 is a perspective view showing a state before a fixed terminal has been compressed according to a first embodiment of the present invention, and FIG. 4 is a perspective view showing a state after a fixed terminal has been compressed according to a first embodiment of the present invention.

Referring to FIG. 3, at the lower end of the fixed terminal 112, may be formed a stopper 120 inserted into a central part of the compression coil spring 113 and maintaining a constant gap between the movable contact and the fixed contact 114 when the movable contact approaches to the fixed contact 114. The stopper 120 may be formed of the same material as the fixed terminal 112, and may have a radius smaller than that of the fixed terminal 112. The compression coil spring 113 may be positioned at the circumference of the stopper 120. In a case that the movable terminal 115 does not approach to the fixed contact 114, the stopper 120 and the fixed contact 114 may be separated from each other. This is illustrated in FIG. 4.

If the movable terminal 115 comes in contact with the fixed contact 114 and the fixed contact 114 is continuously pressurized, the compression coil spring 113 is compressed. At the same time, the fixed contact 114 approaches to the fixed terminal 112. Once the stopper 120 and the fixed contact 114 come in contact with each other, the fixed contact 114 does not approach to the fixed terminal 112 any longer. That is, even if the compression coil spring 113 is in a compressed state by the movable terminal 115, the stopper 120 serves to separate the fixed terminal 112 and the fixed contact 114 from each other with a constant gap therebetween.

Once the stopper 120 and the fixed contact 114 come in contact with each other after the movable terminal 115 and the fixed contact 114 have contacted each other, a current may be supplied to an external device connected to an upper end of the fixed contact 114. In this case, may be reduced noise occurring when the fixed contact 114 and the movable terminal 115 come in contact with each other. Furthermore, the occurrence of arcs may be reduced since the compression coil spring 113 absorbs an impact occurring when the fixed contact 114 and the movable terminal 115 come in contact with each other.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An electromagnetic switching apparatus comprising:

a driving unit having an actuator and configured to control a contact by using an electric signal; and an extinguishing unit configured to switch an external device and comprising:

an electrically conductive fixed terminal configured to penetrate a housing, a fixed contact configured to move in a first direction toward the fixed terminal, and configured to move in a second direction away from the fixed contact, a compression coil spring fixed to the fixed terminal and a second end fixed to the fixed contact, the compression coil spring configured to provide an elastic force to the fixed contact in order to separate the fixed contact from the fixed terminal, and a stopper located near the fixed terminal and inserted into a central part of the compression coil spring, the stopper configured to stop the motion of the fixed contact in the first direction at a predetermined distance from the fixed terminal.

2. The apparatus of claim 1, wherein the extinguishing unit further comprises a moving unit configured to move the fixed contact toward or away from the fixed terminal.

3. The apparatus of claim 2, wherein the driving unit comprises:

an exciting coil configured to generate a driving force for the driving unit;

a fixed core fixed in the exciting coil; and a moveable core facing the fixed core, wherein generating the driving force comprises generating a magnetic force in response to the electric signal.

4. An electromagnetic switching apparatus comprising:

an electrically conductive fixed terminal configured to penetrate a housing;

a fixed contact configured to move in a first direction toward the fixed terminal, and configured to move in a second direction away from the fixed contact;

a compression coil spring having a first end fixed to the fixed terminal and a second end fixed to the fixed contact, the compression coil spring configured to provide an elastic force to the fixed contact in order to separate the fixed contact from the fixed terminal;

a stopper located near the fixed terminal and inserted into a central part of the compression coil spring, the stopper configured to stop the motion of the fixed contact in the first direction at a predetermined distance from the fixed terminal; and a moving unit configured to move the fixed contact toward or away from the fixed terminal.

* * * * *